US005926946A

United States Patent [19]

Minato et al.

[11] Patent Number: 5,926,946

[45] Date of Patent: Jul. 27, 1999

[54] METHOD FOR MANUFACTURING REACTOR

[75] Inventors: Tetsuya Minato, Neyagawa; Toshimitsu Yonehara, Osaka; Junichi Teranishi, Ikoma; Shohei Toyoda, Kyoto; Toshiaki Bito, Neyagawa; Kazushige Takashima, Kawanishi, all of Japan

[73] Assignee: Matsushita Electric Industrial Co., Ltd., Osaka-fu, Japan

[21] Appl. No.: 08/716,869

[22] Filed: Sep. 20, 1996

Related U.S. Application Data

[62] Division of application No. 08/365,157, Dec. 28, 1994, Pat. No. 5,587,694.

[51] Int. Cl.[6] ..... H01F 41/02

[52] U.S. Cl. ..... 29/606; 29/609; 336/65; 336/210; 336/212

[58] Field of Search ..... 29/602.1, 606, 29/605, 609; 336/210, 212, 234, 178, 184, 1.5

[56] References Cited

U.S. PATENT DOCUMENTS

| | | | |
|---|---|---|---|
| 830,272 | 9/1906 | Wilson . | |
| 2,350,029 | 5/1944 | Glass, Jr. . | |
| 2,475,421 | 7/1949 | Camras . | |
| 2,494,180 | 1/1950 | Koubek . | |
| 3,246,273 | 4/1966 | Reade . | |
| 3,522,569 | 8/1970 | Oechsle | 29/602.1 X |
| 3,684,991 | 8/1972 | Trump et al. . | |

FOREIGN PATENT DOCUMENTS

| | | |
|---|---|---|
| 192 307 | 8/1986 | European Pat. Off. . |
| 627 613 | 3/1936 | Germany . |
| 55-11389 | 1/1980 | Japan . |
| 1 393 538 | 5/1975 | United Kingdom . |

*Primary Examiner*—Carl E. Hall
*Attorney, Agent, or Firm*—Wenderoth, Lind & Ponack, L.L.P.

[57] ABSTRACT

Two sets of a combination of an iron core formed of laminated strip-shaped electromagnetic steel plates and a coil are arranged in parallel, and these are abutted via core gap spacers against two iron cores formed of laminated trapezoidal electromagnetic steel plates, so that a square-shaped magnetic path is formed. Two outside iron cores of the four iron cores are coupled and fixed with metal fittings. With such an arrangement, the coil is divided into two, with increased surface areas of the coils and therefore an improved cooling characteristic. Further, since the electromagnetic steel plates used for the iron cores can be formed into simple shapes, electromagnetic steel plates of various sizes can be easily manufactured, so that iron cores of optimum dimensions can be provided, optionally depending on the type of the reactor.

10 Claims, 7 Drawing Sheets

METHOD FOR MANUFACTURING REACTOR

This is a divisional application of Ser. No. 08/365,157, filed Dec. 28, 1994, now U.S. Pat. No. 5,587,694.

BACKGROUND OF THE INVENTION

The present invention relates to reactors for use in electrical and electronic equipment and to a method for manufacturing the same.

As shown in FIGS. 15 and 16, a conventional reactor comprises an iron core 102 formed of laminated E-shaped electromagnetic steel plates 101, an iron core 104 formed of laminated I-shaped electromagnetic steel plates 103, and one unit of coil 105 incorporated into them, where a core gap 106 is previously defined in the E-shaped iron core 102. Two core-butting portions 107 are fixed by welding or the like. A mounting plate 110 for mounting onto other equipment is also attached to the iron core 102 by welding or the like.

Generally, the dimensions of the E- and I-shaped electromagnetic steel plates 101, 103 are of ratios as shown in FIG. 16, with a view to minimizing material loss of the electromagnetic steel plates involved in their punching process. More specifically, two sheets of the I-shaped electromagnetic steel plates 103 and a core gap portion 108 are first punched out with an H-shaped punching die, and then the rest is cut by a cut line 109. As a result, each of two sheets of the E- and I-shaped electromagnetic steel plates 101, 103 are produced at the same time. The resulting material loss of the electromagnetic steel plates is no more than the core gap portion 108.

However, such punching of the electromagnetic steel plates 101, 103 would involve a very expensive die, and therefore the type and the size of the electromagnetic steel plates 101, 103 is limited. Accordingly, when conventional E- and I-shaped electromagnetic steel plates 101, 103 are used to make a reactor, one with approximate dimensions would be chosen from among punched electromagnetic steel plates of standard dimensions prepared in some number of types. As a result, it is often the case that electromagnetic steel plates 101, 103, other than those actually desired have to be used, even though the dimensions of the electromagnetic steel plates 101, 103 are too large relative to those of the coil 105. It has therefore been difficult to attain optimum design in terms of cost for the amount of electrical wires used for the coil 105 and the amount of materials used for the iron cores 102, 104.

Furthermore, this type of reactor is, in general, often located at a place of poor cooling in the equipment to which the reactor is incorporated. Accordingly, the possible effective measures for this situation are only that the reactor would be arranged to have reduced heat generation by suppressing the reactor loss in such a way that the copper loss is reduced by increasing thickness of the wire diameter of the coil 105 or that the reactor loss is reduced by improving the material quality of the iron cores 102, 104. Thus, the reactor has confronted limitations in terms of cost and design.

SUMMARY OF THE INVENTION

Accordingly, it is an object of the present invention to provide a reactor which can solve the conventional problems and which is excellent in economy and productivity and further to provide a method for manufacturing the reactor.

To achieve the above object, according to a first aspect of the present invention, there is provided a reactor wherein two first iron cores each inserted into and penetrated through coils and formed of laminated electromagnetic steel plates are arranged in parallel, and two second iron cores formed of other laminated electromagnetic steel plates are abutted against the first iron cores via core gap spacers so that a square-shaped magnetic path is formed.

According to a second aspect of the present invention, there is provided a reactor wherein two first iron cores each inserted into and penetrated through coils and formed of laminated electromagnetic steel plates are arranged in parallel, and two second iron cores each formed of other laminated electromagnetic steel plates are abutted against the first iron cores via core gap spacers so that a square-shaped magnetic path is formed, wherein at least the two outside-located of iron cores the first and the second iron cores are fixed by a fixing means.

Furthermore, according to a third aspect of the present invention, there is provided a method for manufacturing a reactor comprising the steps of: arranging in parallel two first iron cores each inserted into and penetrated through coils and formed of laminated electromagnetic steel plates; abutting two second iron cores each formed of other laminated electromagnetic steel plates against the first iron cores via core gap spacers having elasticity at least in directions of their thickness so that a square-shaped magnetic path is formed; pressing the iron cores while measuring characteristics such as inductance values, to adjust the thickness of the core gap spacer, which is a size of a core gap; and fixing the iron cores by a fixing means with a pressing force being maintained which results when required characteristics are obtained.

With the above arrangement according to the first aspect of the present invention, since the coil is divided into two so that the cooling surface area of the coil is increased, temperature increase of the reactor is suppressed. Also, since each electromagnetic steel plate can be formed into a simple shape, the electromagnetic steel plates can be manufactured easily by shearing or the like without using expensive punching dies. This makes it possible to adopt different electromagnetic steel plates of minimum dimensions required to accommodate the coils, depending on the type of the reactor.

With the arrangement according to the second aspect of the present invention, a construction can be obtained in which the whole reactor including iron cores and coils is securely fixed.

The thickness of the core gap spacer for ensuring the core gap size has a large impact on the characteristics of the reactor. This would necessitate an extremely high accuracy of the thickness of the core gap spacer, such that a very expensive material must inevitably be used for the core gap spacer. However, the arrangement according to the third aspect of the invention makes it easy to adjust the core gap size to one which meets required reactor characteristics by using a core gap spacer of an inexpensive material having elasticity in its thickness direction.

BRIEF DESCRIPTION OF THE DRAWINGS

These and other objects and features for the present invention will become apparent from the following description taken in conjunction with preferred embodiments thereof with reference to the accompanying drawings, in which.

DETAILED DESCRIPTION OF THE PREFERRED EMBODIMENTS

Figure 1:
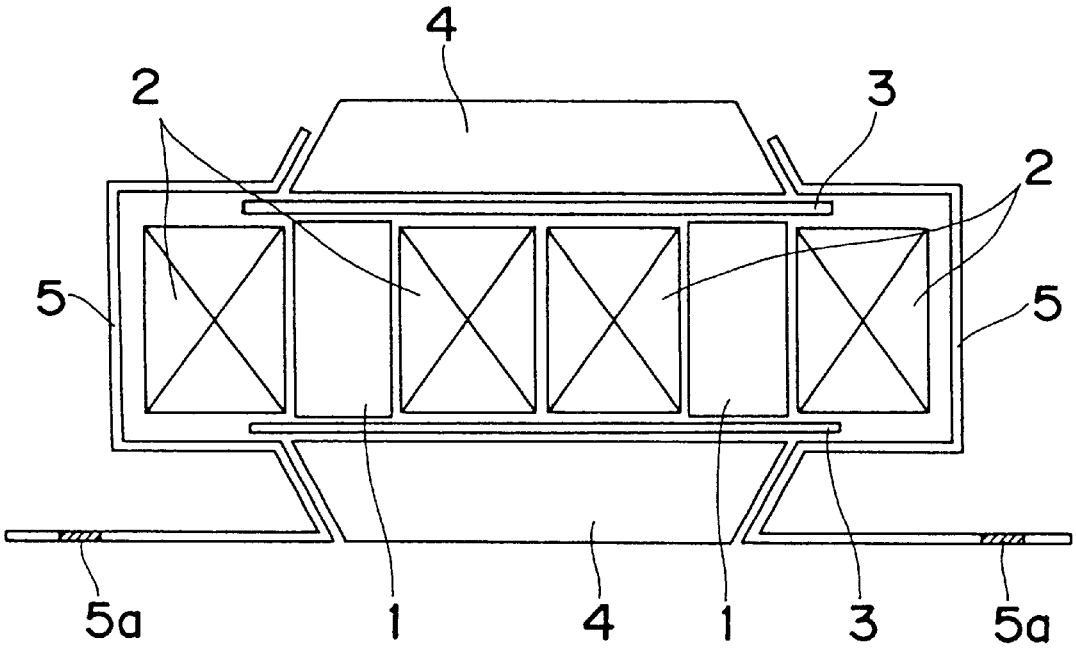
FIG. 1 is a sectional view of a reactor which is a first embodiment of the present invention.

Before the description of the present invention proceeds, it is to be noted that like parts are designated by like reference numerals throughout the accompanying drawings.

A reactor which is a first embodiment of the present invention is described hereinbelow with reference to FIG. 1. The same points as in the conventional reactor are omitted in the description. Referring to FIG. 1, an iron core 1 formed by laminating strip-shaped electromagnetic steel plates and blocking them by a means such as welding, butt-welding, or adhesion is inserted into and penetrated through a coil 2. Two sets of a combination of the iron core 1 and the coil 2 are arranged so as to be juxtaposed, and assembled in such a way that two iron cores 4 formed of laminated trapezoidal electromagnetic steel plates are abutted via core gap spacers 3 each formed of an insulating sheet having elasticity in its thickness direction so that a square-shaped magnetic path is formed. A magnetic flux developed by the two coils 2 connected in forward polarity flows along the square-shaped magnetic path via the core gap ensured by the thickness of the core gap spacers 3, thus exerting characteristics as a reactor.

The outside iron cores 4 of the four iron cores 1, 4 that constitute the square-shaped magnetic path are fixedly welded with a metal fitting 5 integrated with a mounting portion 5*a* for mounting onto other equipment. Thereafter, the whole reactor is varnished.

With the provision of such an arrangement, the coil 2 is divided into two portions, so that the cooling surface area of the coil 2 is increased and therefore the cooling characteristic of the reactor is improved. Thus, the wire diameter of the coil 2 can be reduced, whereby the amount of electrical wires used can be reduced.

The electromagnetic steel plates used for the iron cores 1, 4 may be formed into simple stripped or trapezoidal shape and therefore can be manufactured easily by shearing or the like, eliminating the need of expensive punching dies. Moreover, the size of the electromagnetic steel plates can be set more optionally than in the conventional case. This makes it possible to design the dimensions of the iron cores 1, 4 for accommodating the coils therein to a minimum requirement for each model of the reactor. Thus, the amount of material used for the iron cores 1, 4 can be reduced.

Figure 2:
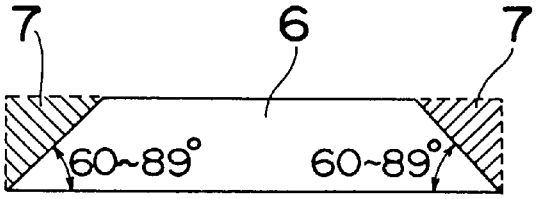
FIG. 2 is an explanatory view of an electromagnetic steel plate used for iron cores of the same reactor.
Figure 3:
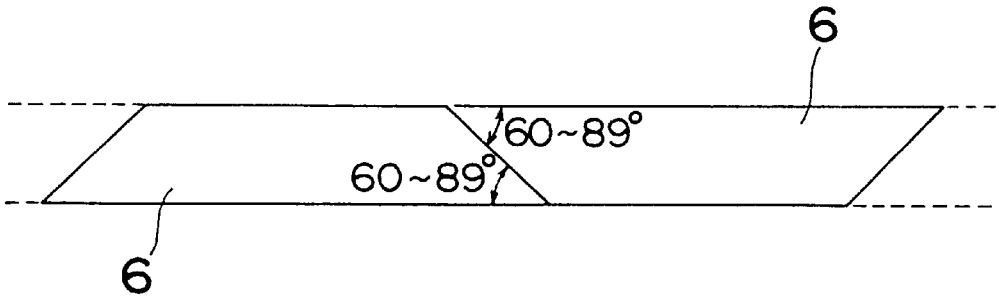
FIG. 3 is an explanatory view of a step for manufacturing the electromagnetic steel plates.

Furthermore, as shown in FIG. 2, an electromagnetic steel plate 6 used for the outside-located iron core 4 of the iron cores 1, 4 that are arranged along the four sides forming the square-shaped magnetic path is formed into such a shape that corner portions 7 ineffective to the flow of magnetic flux are cut away, so that the amount of material of the electromagnetic steel plate 6 used for the iron core 4 is reduced. The angle of the trapezoidal electromagnetic steel plate 6 is selected in a range of from 60° to 89° in terms of practical characteristics. An example of the case where the electromagnetic steel plate 6 is manufactured without any material loss is shown in FIG. 3.

Figure 4:
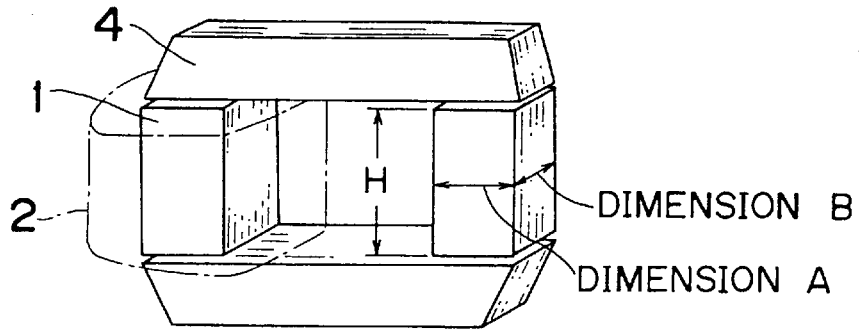
FIG. 4 is an explanatory view of a laminating direction of the iron cores of the reactor.

For the outside iron core 1 of the four iron cores forming the square-shaped magnetic path, when a width dimension A of the iron core 1 is larger than a depth dimension B thereof, the depth dimension B is preferably assumed as the lamination thickness of the iron core 1 as shown in FIG. 4, in which case the number of laminated plates required is reduced advantageously from the standpoint of punching cost of the electromagnetic steel plates used for the iron cores 1. In addition, the dimensions and shape of the electromagnetic steel plates used for the iron cores 1 in this case result in an A×H strip shape (where H is the height dimension of the iron core 1).

Figure 5:
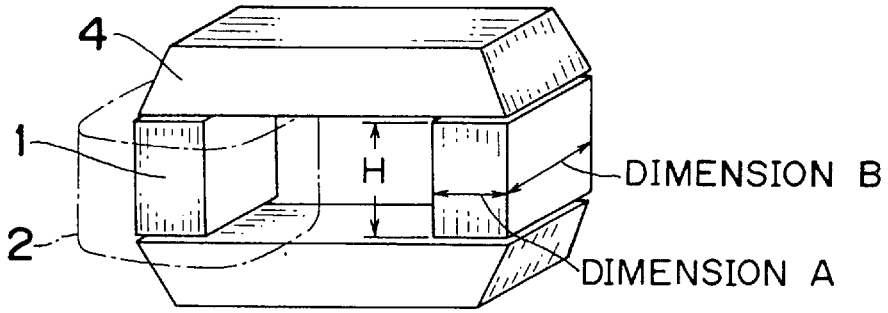
FIG. 5 is an explanatory view of a laminating direction of the iron cores of the reactor.

When the width dimension A of the iron core 1 is smaller than the depth dimension B thereof, on the other hand, the width dimension A of the iron core 1 is preferably assumed as the lamination thickness of the iron core 1 as shown in FIG. 5, in which case the number of laminated plates required becomes smaller advantageously from the standpoint of punching cost of the electromagnetic steel plates used for the iron cores 1.

In the case where an insulating sheet is employed as the core gap spacer 3 required to ensure the core gap and the insulating sheet serves both for ensuring the core gap size and for insulation, all that is needed for the insulation between the coils 2 and the iron cores 4 is the aforementioned insulating sheet. Further, the iron cores 4 and the iron cores 1 are isolated from each other by the insulating sheet, where the iron cores 1 are fully insulated from the iron cores 4 that are to be grounded for mounting or the like. Accordingly, a construction can be realized that requires no additional insulation of the coils 2 from the iron cores 1, 4. This allows a decrease in the insulating material as well as a decrease in the number of assembly manhours because of the simplification of the insulation arrangement. Further, since the insulation between the coils 2 and the iron cores 1 is unnecessary as described above, the coil 2 can be wound directly around the iron core 1, so that the inner diameter of the winding can be reduced to a minimum. This allows a decrease in the material of the electrical wires, a decrease in the number of manufacturing manhours because of the elimination of the need of winding core jigs and the need of the work of separating the wound coils from the winding core jigs, and the like.

Figure 6:
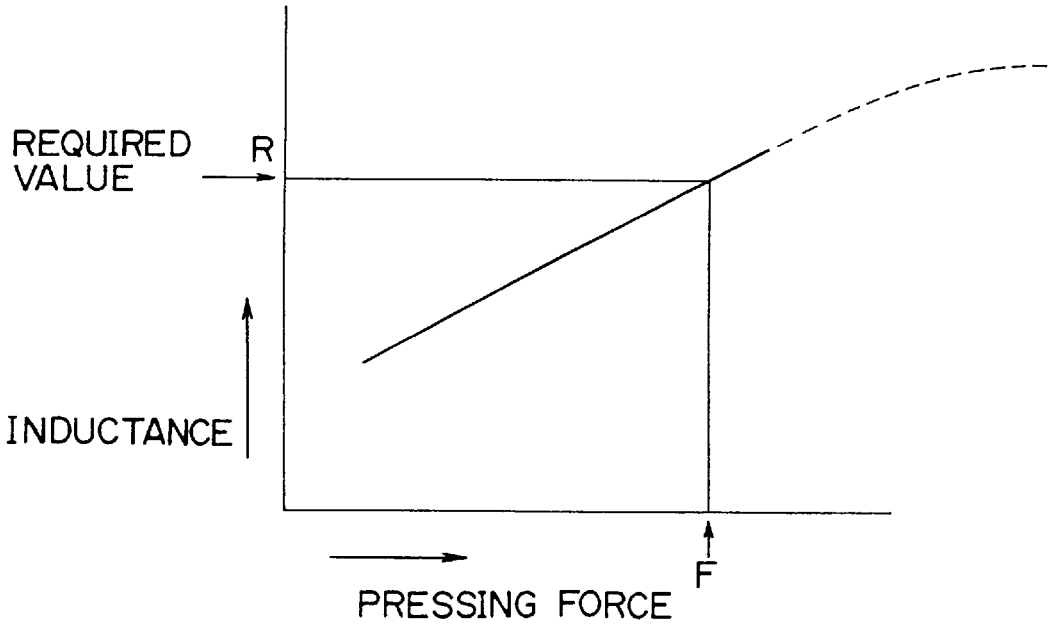
FIG. 6 is a view of the relationship between pressing forces onto the core gap spacer of the reactor and inductance values of the reactor.

Furthermore, on account of the limitations on reactor characteristics, the thickness of the core gap spacer 3 for ensuring the core gap is required to be of quite high accuracy. In the case of the present embodiment, the core gap size for one core gap needs to be 300 $\mu$m±10 $\mu$m, such that a very high cost would be involved if it is attempted to attain this dimensional accuracy with a material which does not have elasticity in its thickness direction. In this connection, the present embodiment uses as the core gap spacer 3 an inexpensive material having elasticity in its thickness direction, such as unwoven glass fabric, unwoven polyester fabric, aramid paper without calendering, the fabric or paper having a thickness larger than required, such that the iron cores 1, 4 can be pressed to thereby press the core gap portion so that the thickness of the core gap spacer 3 having elasticity, or the core gap size, is varied (i.e. the core gap spacer 3 is elastically deformed) depending on the pressing force. With this variation, measuring the inductance values with a measuring device connected to the coils 2 at the same time results in a relationship between the pressing forces and the inductance values as shown in FIG. 6. Accordingly, it is possible to easily make a reactor having a required inductance value R without difficulties by fixing the metal fitting 5 while a pressing force F corresponding to the required inductance value R is maintained. In this way, the material cost can be reduced by using an inexpensive material having elasticity as the core gap spacer 3.

Advantageously, the magnetic force of the reactor itself may also be utilized as the above pressing force, as well as mechanical means such as a press. More specifically, when the coils 2 are powered to cause a current flow therethrough, there develops a magnetic flux in the square-shaped magnetic path so that an electromagnetic force is developed between the four iron cores 1, 4 to create mutual attraction of the cores via the core gap portions, causing the core gap spacer 3 to be pressed. By measuring the current value I with which the coils 2 are powered to generate the pressing force as well as the voltage value V of the reactor at the same time, the resulting inductance value (mH) in the case of alternating current can be found as $V\times10^3$ ($2\pi f\cdot I$), where f is the frequency of the power supply for energizing). Therefore, the required inductance value can be obtained through the calculation by adjusting the energizing current while measuring the voltage value V and the energizing current value I at the same time. Besides, by fixing the metal fitting 5 with the then resulting energizing current maintained, a reactor which has a required inductance value can be made easily.

As shown in FIG. 1, there is such an arrangement that the two outside iron cores 4 of the four iron cores that constitute the square-shaped magnetic path are welded and coupled with the metal fitting 5 having a mounting portion 5*a* for mounting onto other equipment integrated therewith. This allows a secure fixing of the iron cores 1, 4, the coils 2, and the like to constitute the whole reactor. Besides, with the arrangement of the metal fittings serving also for mounting onto other equipment, the amount of material for the metal fittings can be reduced.

Figure 7:
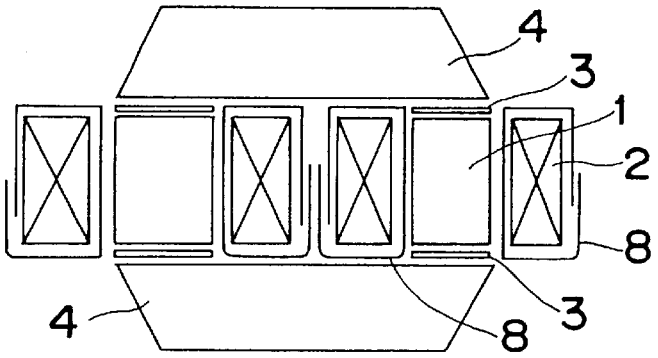
FIG. 7 is a sectional view of a reactor which is a second embodiment of the present invention.
Figure 8:
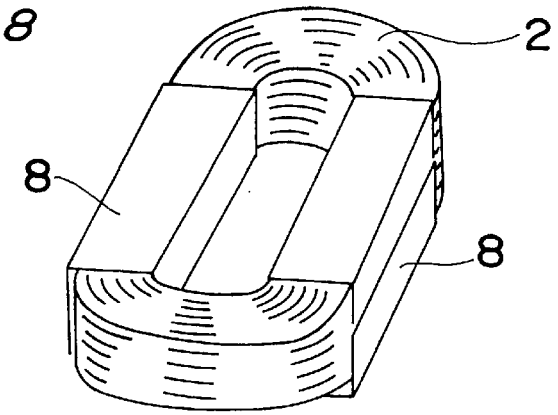
FIG. 8 is an explanatory view for insulation of coils of the same reactor.

Further, as a second embodiment, an arrangement without using an insulating sheet as the core gap spacer 3 is shown in FIG. 7. The same points as in the foregoing embodiment are omitted in the description, and this is similar to other embodiments that will appear hereinbelow. In this embodiment, there arises a need of insulation between the coils 2 and the iron cores 1, 4, so that coil insulating paper 8 is wound around the coils 2 as shown in FIG. 8 to ensure the insulation.

Figure 9:
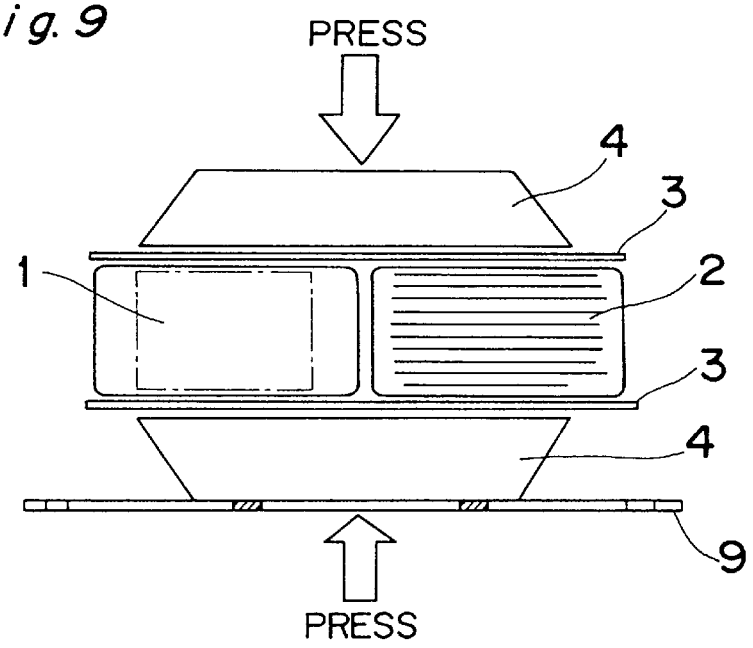
FIG. 9 is a sectional view of a reactor which is a third embodiment of the present invention.

As a third embodiment, it is also advantageous to make a reactor which is arranged as shown in FIG. 9, wherein the reactor is assembled by varnishing and subsequent curing steps while the reactor is pressed from above and below with jigs or the like. Varnishing is generally applied for the purposes of rust prevention of iron cores, suppression of magneto-striction noise, moisture proofing of the coil insulating sheets, and the like. If the varnishing is performed with this arrangement, the iron cores 1, 4 are adhesively fixed to the core gap spacers 3 that are in contact therewith, respectively, so that the reactor including the iron cores 1, 4 and the coils 2 is fixed on the whole. As a result, a reactor having enough strength to provide for practical use can be obtained without using any special metal fittings for coupling the two iron cores 4. It is noted that the mounting plate 9 for mounting onto other equipment is fixed with the iron cores 4 by welding or other means.

Figure 10:
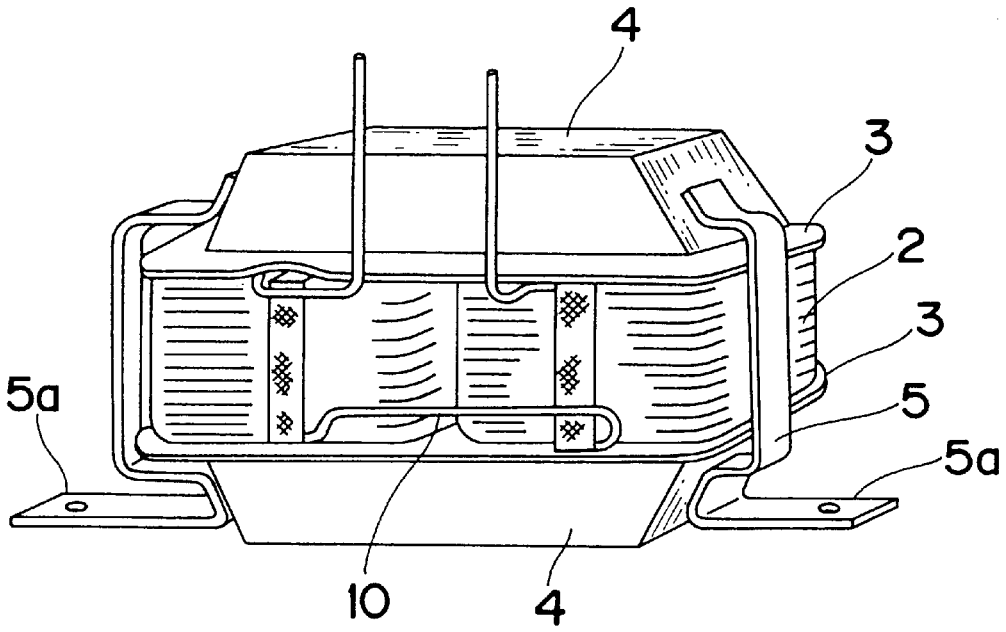
FIG. 10 is an explanatory view of a reactor which is a fourth embodiment of the present invention.

Further, an embodiment of the connection between the two coils 2 is illustrated in FIG. 10 as a fourth embodiment. As the two coils 2 are connected in forward polarity, it normally has so far been necessary in such a case to implement a connecting process, for example, to abut the winding terminated end of one coil which has been cut prior to winding, against the winding start end of the other coil which is similarly cut, by pressure connection with a connecting terminal, or to wind their two leads around each other and then solder them. In the present embodiment, on the other hand, as exemplified by an extended portion 10, the need for connection means is obviated as shown in the figure by winding the first coil and then rather than cutting the winding terminated end of the first coil, winding the resultant winding terminated end of the first coil as the winding start end of the second coil. This can reduce the materials required for the connecting terminals, solder, connection-protective tubes, and the like as well as the manhours required for the connecting process.

Figure 11:
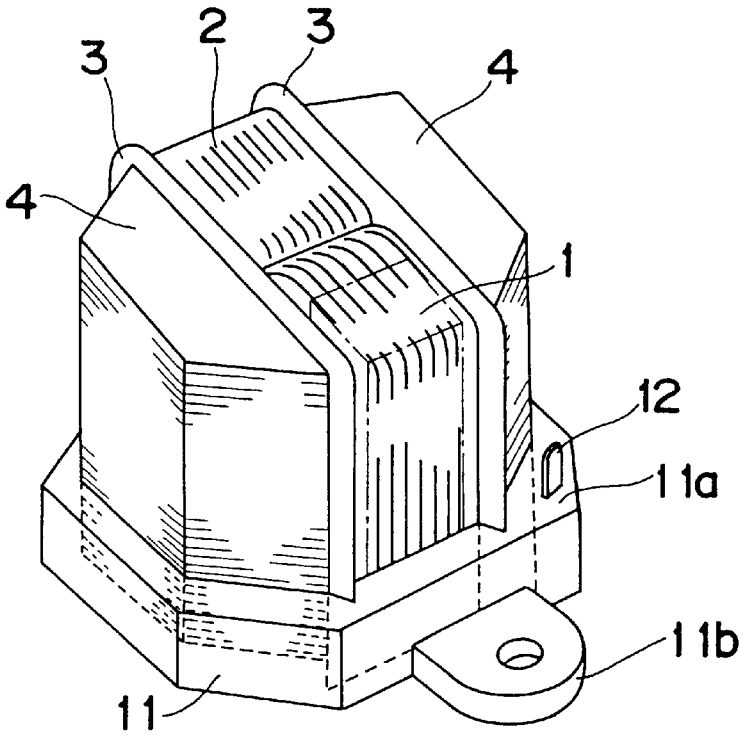
FIG. 11 is an explanatory view of a reactor which is a fifth embodiment of the present invention.

A further embodiment in which a part of a reactor of the present invention is molded with resin is illustrated in FIG. 11 as a fifth embodiment. Molding the iron cores 1, 4 and the coils 2 with resin allows a secure fixing of them, while a resin molded portion 11 can be easily provided with a terminal fixing portion 11*a* for fixing a terminal 12, a mounting portion 11*b* for mounting onto other equipment, and the like. Thus, the manhours for the manufacturing processes can be reduced and a construction well suited to mass production can be realized.

Figure 12:
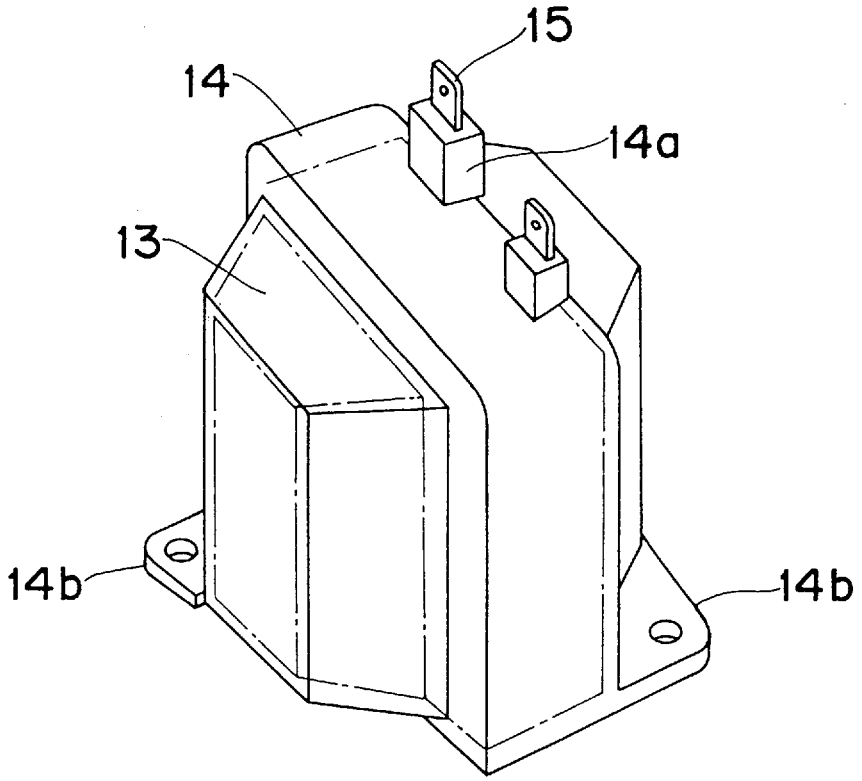
FIG. 12 is an explanatory view of a reactor which is a sixth embodiment of the present invention.

A further example in which the whole of a reactor is molded with resin is illustrated in FIG. 12 as a sixth embodiment. A reactor main body 13 composed of iron cores, coils, and the like is resin-molded as a whole, whereby the iron cores and the coils are fully fixed by a resin mold layer 14, while they can be isolated and protected. As a result, the reactor structure has a very good waterproof property and noise and vibrations therefrom are suppressed. The reactor can also be easily provided with a terminal fixing portion 14*a* for fixing a terminal 15, a mounting portion 14*b* for mounting onto other equipment, and the like, and thus the structure is well suited to mass productivity.

In the embodiments as described heretofore, the description has been made for cases where the outside iron cores of the iron cores 1, 4 that constitute a square-shaped magnetic path as shown in FIG. 1 are used as the iron cores 4, and those iron cores are not inserted into the coils 2. In contrast to this, an embodiment in which iron cores inserted into the coils are located outside is illustrated in FIG. 13 as a seventh embodiment.

Figure 13:
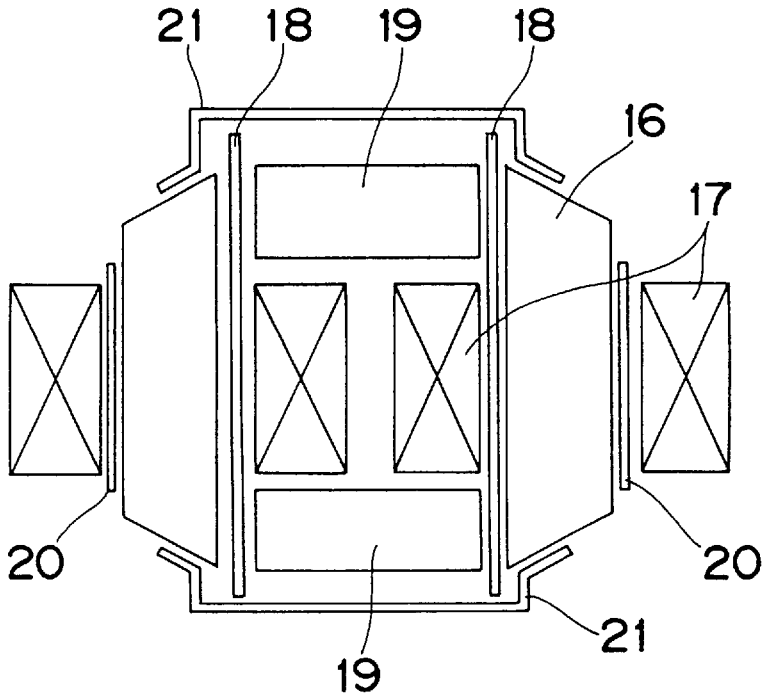
FIG. 13 is an explanatory view of a reactor which is a seventh embodiment of the present invention.

Referring to FIG. 13, iron cores 16 each formed of laminated trapezoidal electromagnetic steel plates are inserted into and penetrated through coils 17 and abutted against iron cores 19 via core gap spacers 18. Each of the iron cores 19 is formed of laminated strip-shaped electromagnetic steel plates, and each of spacers 18 is formed of an insulating sheet, so that a square-shaped magnetic path is formed. Each iron core 16 is located outside among the four iron cores 16, 19 that constitute the square-shaped magnetic path. Since the iron cores 19 are insulated from the grounding by the insulating sheet 18 serving also as the core gap spacer, the need for other insulation between the iron cores 19 and the coils 17 is obviated. However, the iron cores 19 located inside the coils 17 are grounded via metal fittings 21, requiring the insulation therebetween, so that sheets of coil insulating paper 20 are attached. The two iron cores 19 located outside are fixed by welding with the metal fittings 21. Both functions and advantages of the present embodiment are the same as in the first embodiment and therefore their detailed description is omitted.

Figure 14:
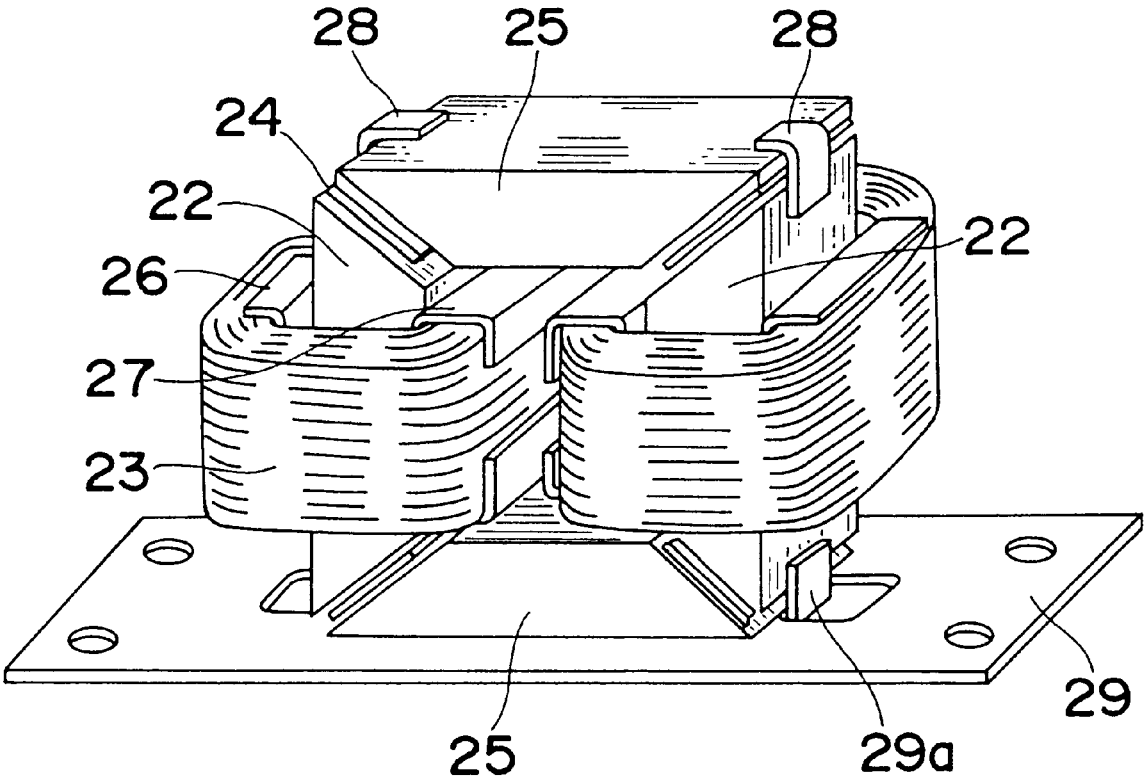
FIG. 14 is an explanatory view of a reactor which is an eighth embodiment of the present invention.
Figure 15:
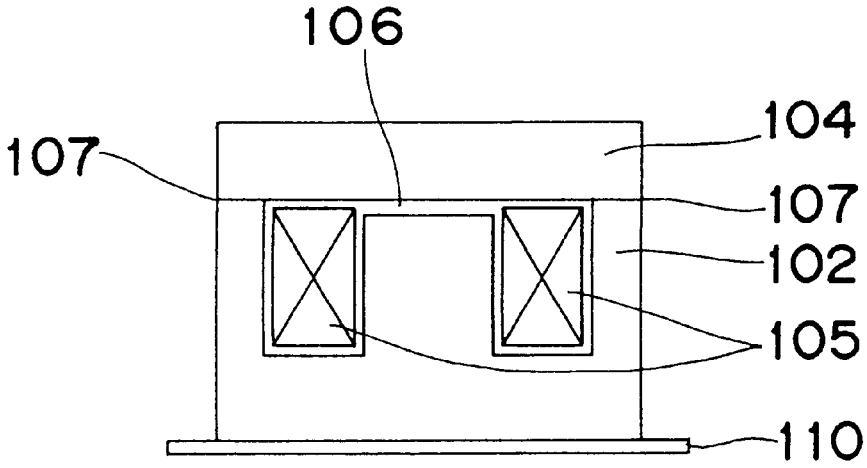
FIG. 15 is a sectional view of a conventional reactor.
Figure 16:
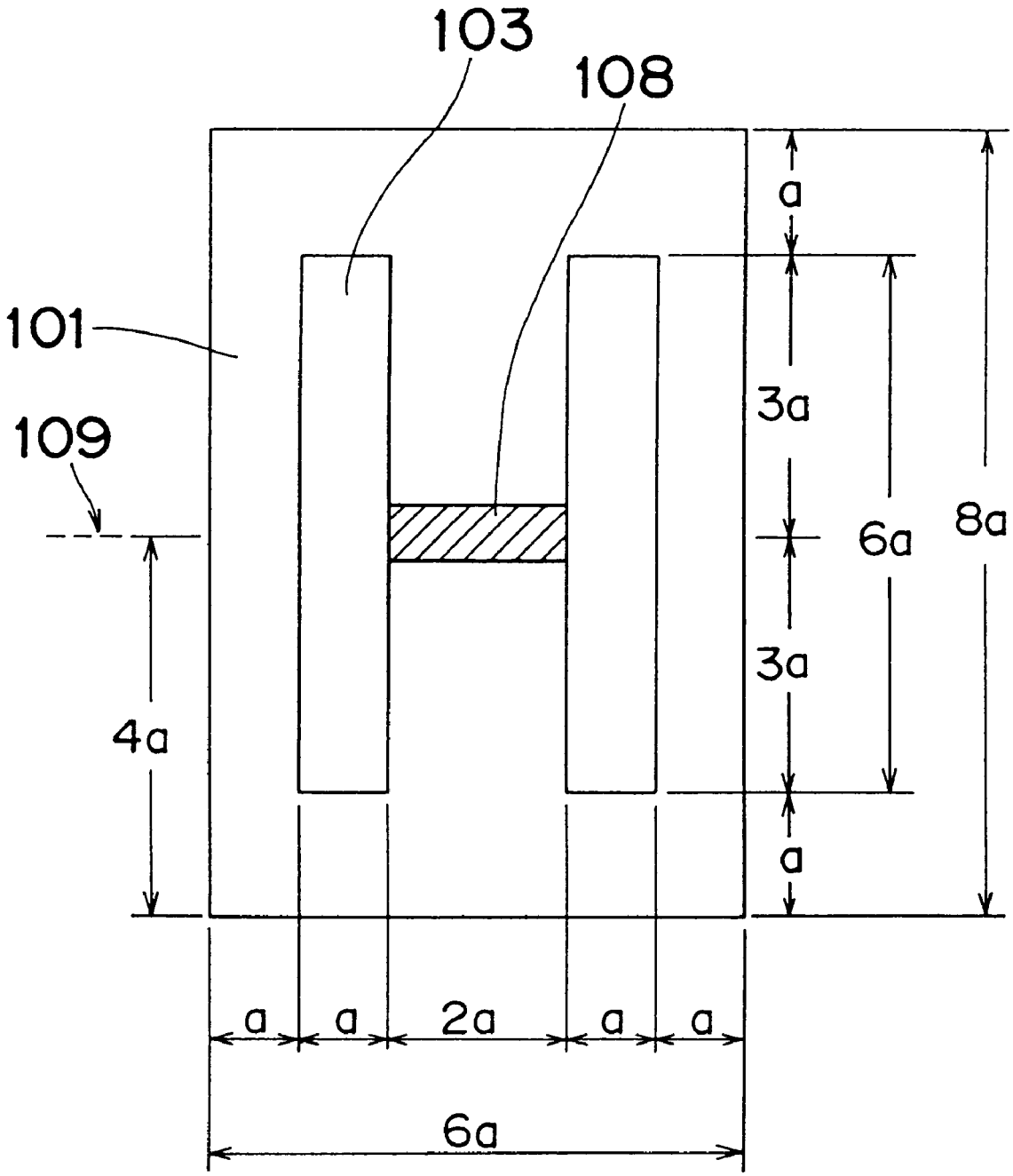
FIG. 16 is an explanatory view of a step for manufacturing electromagnetic steel plates used for iron cores of the same reactor.

An eighth embodiment in which the first and second iron cores are all made trapezoidal is now described with reference to FIG. 14.

Iron cores 22, each formed of laminated trapezoidal electromagnetic steel plates, are inserted into and penetrated through coils 23. Two sets of a combination of the iron core 22 and the coil 23 are arranged side by side, and two iron cores 25, each formed of laminated similarly trapezoidal electromagnetic steel plates, are assembled so as to be abutted via core gap spacers 24 each having elasticity in its thickness direction, in such a way that a square-shaped magnetic path is formed. The insulation between the coil 23 and the iron cores 22, 25 is ensured by sheets of coil insulating paper 26, 27. The iron cores 22, 25 are welded and fixed with metal fittings 28, a mounting plate 29 for mounting onto other equipment, and an iron-core mounting portion 29*a* formed from a cut and raised portion of the mounting plate 29.

With such an arrangement, as in the first embodiment, it becomes possible to reduce the amount of the material of electrical wires used as well as the amount of the material of iron cores used. Further, since the iron cores 22 and the iron cores 25 may be formed into a similar trapezoidal shape, the manufacturing cost for these iron cores can be reduced by making them absolutely identical to one another in shape and dimensions.

In the present embodiment, the insulation between the coil 23 and the iron cores 22, 25 has been implemented by the sheets of coil insulating paper 26, 27 wound inside the coil 23. However, it is also advantageous to wind the insulating paper on the iron cores 22, 25 or to apply such insulation processing as resin coating on the surface of the iron cores.

As is apparent from the foregoing description of the embodiments, the reactor of the present invention is increased in the cooling surface area of the coils by the division into two coils, improving the cooling efficiency. Thus, the wire diameter of the coils can be reduced, and therefore the amount of electrical wires used can be reduced. Moreover, since the electromagnetic steel plate used for the iron cores can be formed into a simple shape, the need for expensive punching dies is obviated, allowing the electromagnetic steel plates to be manufactured easily by shearing or the like and with low cost. Thus, it becomes possible to adopt different electromagnetic steel plates of minimum dimensions required to accommodate the coils, depending on the type of the reactor, so that the material used for the iron cores can be reduced in amount.

In this reactor, by coupling two outside iron cores of the first or second iron cores using fixing means, the reactor including the four iron cores, the two coils, and the core gap spacers can be securely fixed to form the reactor.

Furthermore, the method for manufacturing the reactor comprises steps of adjusting the thickness of the core gap spacer, which is the size of the core gap, while measuring characteristics such as the inductance value, and fixing the iron cores with the fixing means while maintaining a pressing force that results when required characteristics are obtained. Therefore, the core gap spacer, which otherwise would be required to be made of a very expensive material because of a demand for a very high accuracy of its thickness dimension, may be made of an inexpensive material not requiring accuracy on its thickness dimension. Thus, the material cost can be reduced.

Although the present invention has been fully described in conjunction with preferred embodiments thereof with reference to the accompanying drawings, it is to be noted here that various changes and modifications will be apparent to those skilled in the art. Therefore, unless such changes and modifications otherwise depart from the scope of the present invention as defined by the appended claims, they should be construed as included therein.

What is claimed is:

1. A method for manufacturing a reactor, comprising:

arranging in parallel two first iron cores formed of electromagnetic steel plates laminated together, and inserting said two first iron cores through at least one coil to form an electromagnetic core and coil assembly;

arranging two second iron cores formed of electromagnetic steel plates laminated together such that said second iron cores butt against said first iron cores via core gap spacers which are elastically deformable at least in a thickness direction, to thereby form a square-shaped magnetic path;

adjusting thicknesses of said core gap spacers by imposing a pressing force in the thickness direction of said core gap spacers to elastically deform said core gap spacers;

while adjusting said thicknesses, electrically energizing said at least one coil and monitoring an electromagnetic characteristic of said electromagnetic core and coil assembly; and when said electromagnetic characteristic attains a desired value, fixing relative positions of said first and second iron cores so as to maintain said core gap spacers at the thicknesses present when said electromagnetic characteristic attains said desired value.

2. A method for manufacturing a reactor, according to claim 1, wherein said monitoring of said electromagnetic characteristic comprises monitoring of inductance.

3. A method for manufacturing a reactor, according to claim 1, wherein in adjusting the thicknesses of said core gap spacers, said imposing of said pressing force comprises electrically energizing said at least one coil.

4. A method for manufacturing a reactor, according to claim 1, wherein said inserting of said two first iron cores through said at least one coil comprises inserting said two first iron cores through two coils, respectively.

5. A method for manufacturing a reactor, according to claim 1, wherein said fixing of the relative positions of said iron cores comprises securing at least one metal fitting to said two second iron cores.

6. A method for manufacturing a reactor, according to claim 1, wherein said fixing of the relative positions of said iron cores comprises securing at least one metal fitting to said two first iron cores.

7. A method for manufacturing a reactor, according to claim 1, wherein said fixing of the relative positions of said iron cores comprises fixing said first and second iron cores together with varnish.

8. A method for manufacturing a reactor, according to claim 1, wherein said fixing of the relative positions of said iron cores comprises fixing said first and second iron cores together with resin-molding.

9. A method for manufacturing a reactor, according to claim 1, wherein said fixing of the relative positions of said iron cores comprises securing a metal fitting between abutting portions of each adjacent pair of said iron cores.

10. A method for manufacturing a reactor, according to claim 1, wherein said arranging of said two second iron cores comprises arranging said two second iron cores parallel to each other and substantially perpendicular to said two first iron cores.

* * * * *